United States Patent [19]

Heieren

[11] Patent Number: 5,059,972

[45] Date of Patent: Oct. 22, 1991

[54] METHOD FOR ASSEMBLING ELEMENTS TO A RADOME

[76] Inventor: Erik V. Heieren, Moltzaus vei, 3506 Royse, Norway

[21] Appl. No.: 451,443

[22] Filed: Dec. 15, 1989

[51] Int. Cl.[5] ..... H01Q 1/42

[52] U.S. Cl. ..... 343/872; 52/747; 156/295

[58] Field of Search ..... 343/872, 784; 52/248, 52/746, 747; 156/295, 63

[56] References Cited

U.S. PATENT DOCUMENTS

| | | | |
|---|---|---|---|
| 2,914,074 | 11/1959 | Fuller | 343/872 |
| 2,978,704 | 4/1961 | Cohen et al. | 343/872 |
| 3,002,590 | 10/1961 | Hannoosh et al. | 343/872 |
| 3,400,401 | 9/1968 | Shaw | 343/872 |
| 4,075,813 | 2/1978 | Nalick | 52/747 |
| 4,262,717 | 4/1981 | Kohn | 156/264 |
| 4,779,393 | 10/1988 | Jong | 52/747 |

*Primary Examiner*—Michael C. Wimer
*Assistant Examiner*—Hoanganh Le
*Attorney, Agent, or Firm*—Dressler, Goldsmith, Shore, Sutker & Milnamow

[57] ABSTRACT

Method of constructing a radom of a spherical structure by forming rings of interconnected part spherical elements and securing the rings to each other. Each ring is formed of elements that are glued and mechanically interconnected. Radial pressure during the glue curing action is provided by a hoop strap tightened around each ring. Vertical pressure during the glue curing action is provided by a pressure distribution plate that is biased downwardly by a clamping strap anchored at the bottom of the radom.

4 Claims, 1 Drawing Sheet

METHOD FOR ASSEMBLING ELEMENTS TO A RADOME

BACKGROUND OF THE INVENTION

The present invention is related to a method for constructing a spherical structure, especially a radome, of part spherical elements made of a rigid plastics foam.

Radomes are used especially for protection of antennas for radar and different types of radio transmitters to protect such antennas against atmospherical disturbances which may decrease the functional performance of antenna or even destroy the antenna. As the radomes are covering the antennas in all directions, the material of the radomes necessarily will affect radio or radar waves out from the antenna as well as the opposite direction. This decreasing effect is connected especially with radomes comprising a frame work structure as the load bearing part of the radome, which structure then is cover by a shell.

Self bearing shell structures have been, assembled of a plurality of elements. Such elements also affect radio signals, but the affect is minimized by a suitable material choice. Element joints in such radomes to a certain degree affect the radio waves. Development has proved that elements made of structural foam have correct structural strength and as well as dielectric properties.

Large radomes constructed by a plurality of elements also are restricted in many ways as to choice of the element materials and structure design, connected with very strong conditions as to dielectrical functions even in different radio frequency wave bands. To fulfil such claims, shell radomes made of structural foam with low specific dielectrical values and without dielectric discontinuity in the joints, will have many advantages. Such structures, however, claim a method for construction which in practical use when assembling the radome, satisfy the claims for mechanical and dielectrical values.

SUMMARY OF THE INVENTION

Materials providing correct properties are available, such as structural foams and the present invention is related to a method for assembling elements made of such foam, thereby securing the strength of the structure and avoiding parts in the radome which may decrease the desired properties.

This is achieved with the method according to the present invention as defined by the features of the claim program.

BRIEF DESCRIPTION OF THE DRAWINGS

In the drawing FIG. 1 discloses a vertical section through a radome during construction, FIG. 2 discloses a portion of a radome shell or wall as a section in the middle of the wall, FIG. 3 discloses a section as marked with-III in FIG. 4 and FIG. 4 discloses an enlarged portion IV in FIG. 2.

DETAIL DESCRIPTION OF THE DRAWINGS

Figure 1:
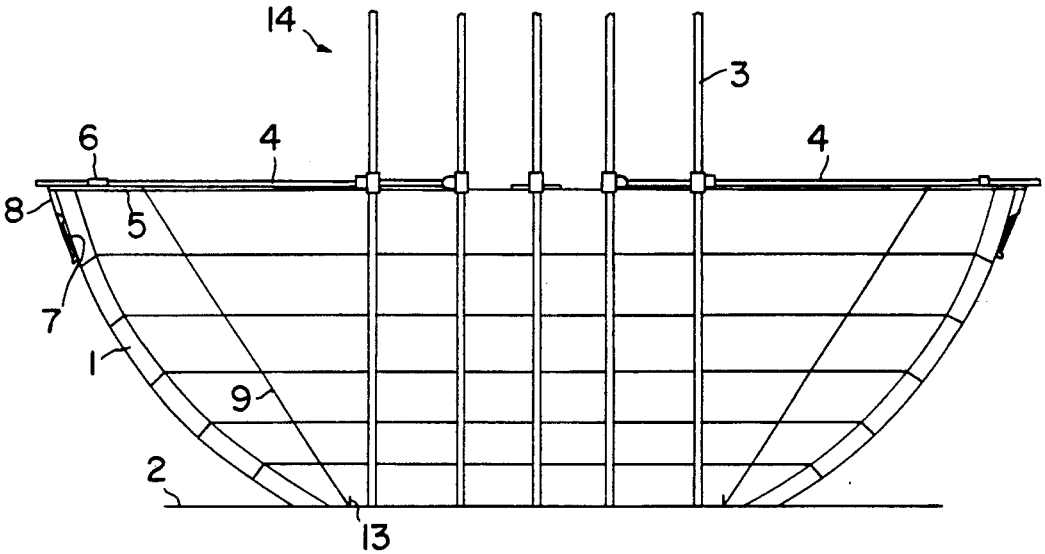
Figure 2:
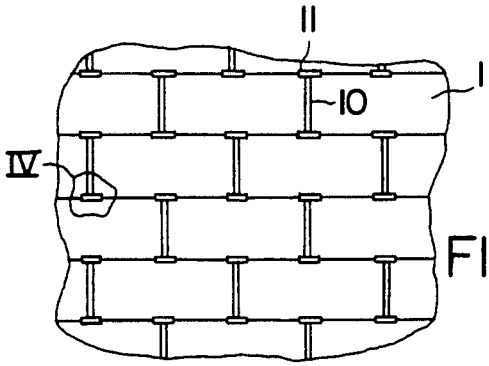

The radome is erected around a scaffold 14 on a ground 2. Shell elements 1 made of structural foam are arranged as a ring and joined at their vertical edges with vertical joint pieces 10 and with the underlying ring of elements with joint pieces 11. The joint pieces are inserted in corresponding grooves in each element and secured to the elements by pins 12, preferably made of nylon after the elements have been glued together.

The present invention provides a method for securing that all elements 1 in one ring are pressed together in such a way that the vertical edges of each element are kept under pressure towards adjacent element during at least the glue curing time and that simultaneously the ring is pressed downwards towards the underlying ring during the glue curing time for the glue between elements belonging to the two rings.

According to the present invention, the necessary pressure in vertical and radial direction is achieved by a plurality of horizontal protuding tubes 4 vertically slideable on scaffolding columns 3 thereby providing possibility to adjust the tubes to the level of the upper edge of the elements of a ring.

Each tube 4 is provided with a bushing 6 being slidably secured in the longitudinal direction of the tube, each bushing thereby having secured a pressure distribution plate 5 between the tube and the element 1. Upon arranging all elements 1 of ring with inserted vertical and horizontal joint pieces 10 and 11 and all elements also being provided with glue, the tube 4 is adjusted vertically to press the distribution plate 5 against the upper edge of the ring established by the elements 1.

Arranged on each horizontal tube 4 is a holding strap 8 through which is arranged a hoop strap 7 surrounding the entire ring of elements 1. By tightening the hoop strap 7, which in fact may be a commercially available cargo strap, presses all elements of the ring radially, whereby simultaneously a force presses the distribution plate 5 downwards by securing a clamping strap 9 to the tube 4, which strap at the other end is secured to a base bolt 13 in the ground or other suitable anchoring.

Figure 3:
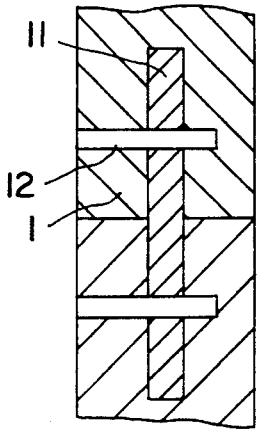
Figure 4:
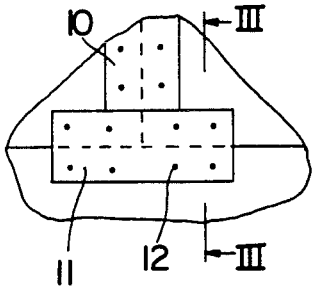

The clamping strap 9 and the hoop strap 7 are tightened and maintained under pressure during the entire curing time of the glue, whereafter the pins 12 are brought into the elements through the joint pieces 10 and 11 as disclosed in FIG. 3. Next ring thereafter may be prepared likewise by arranging elements 1 provided with glue and horizontal and vertical joint pieces connecting the elements in the new ring as well as to the new ring to the ring below.

The radial forces from the hoop strap 7 are substantially equally distributed around the entire circumference of the ring and the downwards directed pressure from the pressure distribution plates 5 also substantially is uniformly distributed to the upper surface of the elements, depending on the number of horizontally arranged tubes 4.

What is claimed is:

1. Method of constructing a generally spherical structure of part spherical elements into a radome comprising the steps of forming a first horizontal ring of the elements, applying glue between adjacent elements, mechanically joining the adjacent elements together in abutting relationship, arranging a hoop strap around the entire circumference of the ring, providing a vertical pressure to the ring of elements and tightening the hoop strap to maintain a vertical and radial pressure during the entire glue curing time to form said first horizontal ring, forming subsequent rings on a top of said first horizontal ring by gluing and mechanically joining the elements of each ring to each other and to an adjacent ring until the radome is completed.

2. A method as set forth claim 1 in which the adjacent elements of each ring are mechanically connected by joint pieces and a groove construction in said elements and the joint pieces are secured to its respective element by inserting nylon pins through the elements and joint pieces.

3. A method as set forth in claim 2 in which the vertical pressure applied against the rings during the glue curing time is provided by a pressure distribution plate biased against an upper surface of the uppermost ring during the formation process.

4. A method as set forth in claim 3 in which there is provided a plurality of horizontally protruding tubes that are secured to a column of a scaffold arranged in the middle of the radome and the pressure distribution plate is arranged between the tubes and a clamping strap is connected to the tubes and anchored at the bottom of the radome acts to apply the vertical pressure to the pressure distribution plate during the glue curing process.

* * * * *